United States Patent [19]

LaCross

[11] 4,183,445

[45] Jan. 15, 1980

[54] TETHERED TAB WITH CHANGEABLE BEND LINE

[75] Inventor: George D. LaCross, Burbank, Ill.

[73] Assignee: The Continental Group, Inc., New York, N.Y.

[21] Appl. No.: 959,116

[22] Filed: Nov. 9, 1978

[51] Int. Cl.[2] ..... B65D 41/32

[52] U.S. Cl. ..... 220/273; 220/269

[58] Field of Search ..... 220/269–273

[56] References Cited

U.S. PATENT DOCUMENTS 4,022,346 5/1977 Khoury ..... 220/273

*Primary Examiner*—George T. Hall

*Attorney, Agent, or Firm*—Charles E. Brown

[57] ABSTRACT

A pull tab for easy opening containers wherein the pull tab has an intermediate attaching portion in the form of a strap struck from the center of the tab body for securing the tab to the container wall by means of a conventional rivet. A first strap is defined by a cutout in the tab body. There is a second strap portion which is connected to the tab body but which has a longitudinal sliding connection with the rivet. This longitudinally elongated slot opening permits a force applying portion of the tab to shift longitudinally relative to the rivet with a resultant changing in the bending point or pivot point for the tab, thereby reducing prior experienced stresses and permitting the necessary opening force to be applied to the rivet through the pull tab without the customary tab failure problem.

16 Claims, 3 Drawing Figures

FIG.1
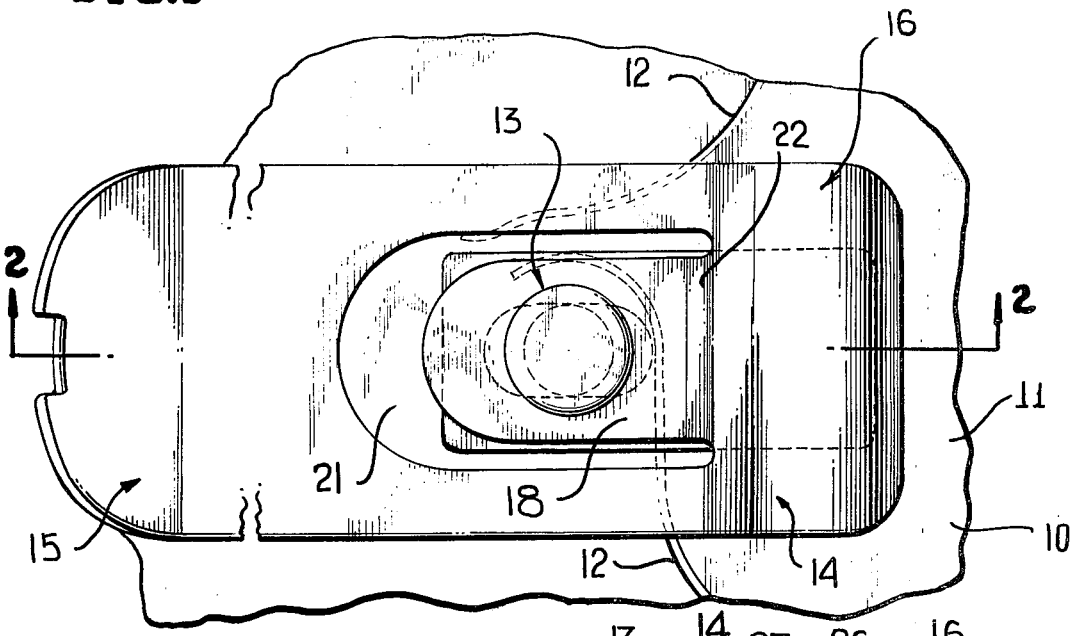
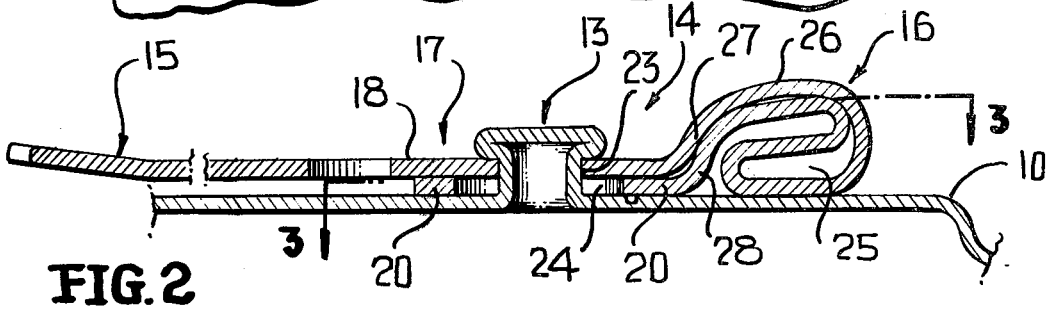
FIG.2
FIG.3
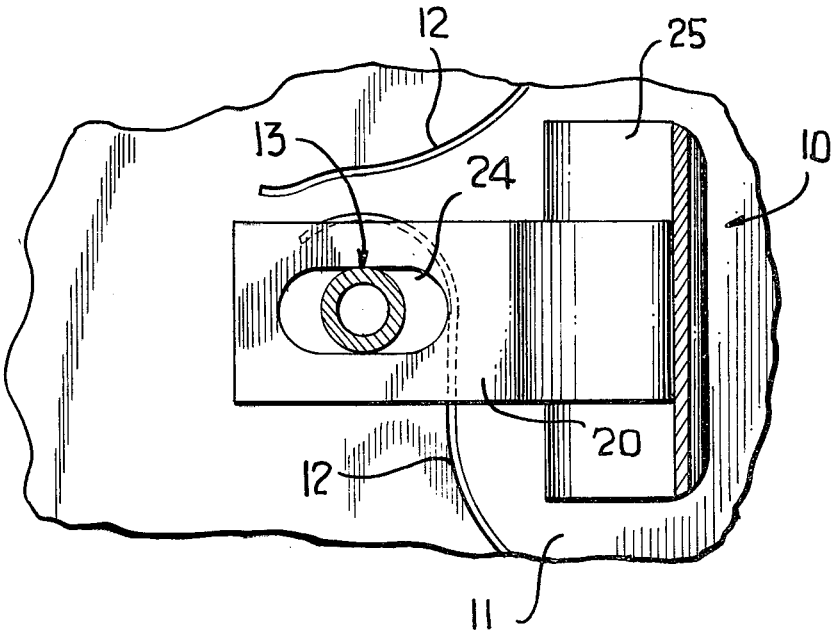

TETHERED TAB WITH CHANGEABLE BEND LINE

This invention relates in general to new and useful improvements in easy opening containers, and more specifically to an easy opening container of the type wherein a pull tab is utilized to initiate and effect the opening operation.

This invention particularly relates to an improvement in the pull tab.

One of the difficulties with pull tabs is the tendency of the tab to break during an opening operation. This invention relates to a tab which has the usual connection to the container wall by way of a rivet, and additionally has a second portion fixed against axial movement along the rivet away from the container wall, but movable relative to the rivet in the direction of tab length so as to permit the bend point or line of the tab to change a slight amount during the bending and opening operation.

Most particularly, this invention relates to a tab which has partially cut from an intermediate portion thereof a strap which is connected to a force applying portion by means of a transverse hinge. The strap is fixedly secured to the container wall by a rivet and, during the opening operation, the lifting portion of the tab may be lifted with the tab bending about the hinge line between the strap and a force applying portion of the tab to effect an inwardly directed force on the container wall by the force applying portion of the tab. There is a tendency both for the tearing of the tab from the rivet and the rupturing of the tab along the hinge connection between the strap and the force applying portion. In accordance with this invention, a second strap extends from the force applying portion and is engaged over the rivet, the second strap having a longitudinally elongated slot receiving the rivet whereby the second strap is longitudinally shiftable to a limited extent relative to the rivet during the lifting of the lifting portion of the tab so that the point where bending of the tab relative to the first strap occurs may shift during the opening operation.

This invention particularly relates to a non-detachable tab which is secured to a panel portion having therein a displaceable portion which, when the tab is actuated, presses the displaceable portion into the interior of the container to facilitate the dispensing of the product. While the tab is intended to be non-detachable, there is a tendency for users of such an easy opening container to bend the tab back and forth repeatedly after the opening process has been completed so as to attempt to remove the tab.

Some of the patents which are known to applicant (U.S. Pat. No. 3,967,752 and U.S. Pat. No. 3,957,753) disclose a non-detachable tab by providing a separate dead soft aluminum attachment strip reinforcement which extends between the rivet attachment of the tab to the can end and the nose portion. What has been experienced is that if the user twists the tab he will quickly break the strip. A further problem with the tab disclosed in the above-identified U.S. patents is the cost of manufacture and the complexity of putting in a separate piece of material.

Other non-detach tab patents are U.S. Pat. No. 3,618,815, using two rivets; Re. No. 27,518, in which a single hinge line is used; and U.S. Pat. No. 3,749,275, which also uses two rivets.

In accordance with this invention, by providing the second connecting strap or mounting ear and having an elongated rivet receiving opening formed therein, as the tab is repeatedly bent back and forth, the second connecting strap shifts relative to the rivet and the first connecting strap or mounting ear, thereby changing the bend line both in the first connecting strap and the second connecting strap. By providing a shifting bend line, that portion of the tab which is subjected to fatigue due to bending is greatly widened, with the result that the tab provides a much greater resistance to breakage due to bending fatigue than is normally possible.

A further feature of the tab is that the force applying portion of the tab is reversely turned on itself so that in addition to the double thickness provided for by the second strap, the tab further has its thickness again doubled so that the force applying portion is of a four-layer construction.

With the above and other objects in view that will hereinafter appear, the nature of the invention will be more clearly understood by reference to the following detailed description, the appended claims, and the several views illustrated in the accompanying drawings.

IN THE DRAWINGS

FIG. 1 is a plan view of a portion of a container wall bearing a rivet and having secured thereto a pull tab formed in accordance with this invention.

FIG. 2 is a vertical sectional view taken along the longitudinal center of the tab, and shows more specifically the constructional details of the tab.

FIG. 3 is a fragmentary horizontal sectional view taken generally along the line 3—3 of FIG. 2, and shows more specifically the details of the second strap and the connection thereof to both the remainder of the pull tab and to the rivet.

Referring now to the drawings in detail, it will be seen that there is illustrated a container panel 10 which may be an end panel of an end unit. The container panel 10 has a push-in panel portion 11 defined by a score line 12, both of which being only partially illustrated in FIG. 1. The container panel 10 is provided with an integral rivet 13 which serves to secure a pull tab, generally identified by the numeral 14, to the container panel. This invention particularly resides in the construction of the pull tab 14.

The pull tab 14 is formed from an elongated strip of metal which is configurated to include a lifting portion 15 at one end, a force applying portion 16 at the opposite end, and an intermediate portion 17. The intermediate portion 17 has extending therethrough the rivet 13.

The intermediate portion 17, as best shown in FIG. 2, is of a double layer thickness and includes an outer layer in the form of a connecting strap 18 and an inner layer in the form of a second connecting strap 20. As is best shown in FIG. 1, the connecting strap 18 is formed from the central portion of the strip from which the pull tab 14 is formed by a generally C-shaped cutout 21. The strap portion 18 is narrow as compared to the overall width of the pull tab 14 and is hingedly connected to the force applying portion 16 along a transverse hinge line or connection 22. The strap 18 has formed in the central part thereof an opening or aperture 23 of a cross section in size to be snugly received over the rivet 13.

Normally pull tabs of this type have the lifting portions 15 of a desired configuration and the force applying portion 16 is generally coplanar with the attaching portion 17. However, in accordance with this invention there is the additional strap portion 20 which extends toward the lifting portion from the force applying portion and is also received over the rivet 13. The second strap portion 20 has a longitudinally elongated opening 24 formed therein, as is best shown in FIG. 3. The opening 24 is of a width snugly to engage the stem portion of the rivet 13 while permitting relative longitudinal movement between the second strap portion 20 and the rivet 13.

It is to be understood that the pull tab 14 could be readily formed by merely reversely folding the metal of the strip forming the tab at the end of the force applying portion remote from the rivet and having the second strap portion 20 extending therefrom. However, in accordance with this invention, the force applying portion is made longer than required and is further doubled upon itself in an underlying manner so as to provide for a doubled portion 25 which overlies a double thickness upper or outer portion of the force applying portion of the tab. The net result is that the outermost layer 26 of the force applying portion 16 is upwardly or outwardly offset as at 27 adjacent the transverse hinge connection 22. In a like manner, the second strap portion 20 forms an inner layer of the double thickness portion and it too is offset outwardly and upwardly, as viewed in FIG. 2 as at 28. This permits the reversely bent portion 25 to nest between the two outer layers of the force applying portion 16.

It will be seen that when the lifting portion 15 of the pull tab is elevated, the strap portion 18 being substantially fixed by the rivet 13, requires a bending of the remainder of the strap relative to the strap portion 18 along generally the transverse bend line 22. If there is a twisting of the pull tab as opposed to a direct lifting thereof, such twisting is resisted by the second strap portion 20, as are longitudinal tearing forces.

As the pull tab is lifted, and hinging does occur along the hinge line 22, there is a tendency for the strap portion 20 to shift longitudinally of the tab relative to the rivet. By making the opening 24 through the second strap portion elongated in the general direction of the tearing force, it will be seen that the force applying portion of the pull tab is not unduly restrained by the strap portion 20 while being free to permit relative bending of the strap portion 18 with respect thereto during the opening of a container wall. Because the inner strap portion 20 is not longitudinally fixed by the rivet 13, the force applying portion 16 is free to shift longitudinally relative to the rivet 13, thereby shifting the hinge position for the tab and thus permitting greater opening forces to be applied by the tab without rupture occurring.

It will be readily apparent that should the tab be repeatedly bent back and forth relative to the rivet after the panel portion 11 has been moved to the container opening position, the connecting strap 20 will shift back and forth relative to the rivet 13, thereby effecting a change wherein bending occurs in that strap portion. At the same time, the point where bending of the strap portion 18 occurs will change due to the effect of the change in the bending line of the strap portion 20. The net result will be that the bend line 22 will shift back and forth longitudinally of the tab and rupture of the strap portions 18 and 20 due to bending fatigue will require considerably more back and forth bending than heretofore normally required to effect rupture of the tab.

Although only a preferred embodiment of the pull tab has been specifically illustrated and described herein, it is to be understood that minor variations may be made in the pull tab without departing from the spirit and scope of the invention as defined by the appended claims.

I claim:

1. A pull tab for an easy opening container, said pull tab comprising a lifting portion, a force applying portion and an intermediate attaching portion, said tab being in the form of an elongated strip partially reversely folded upon itself in said force applying portion with said attaching portion and said force applying portion being of a double thickness, and aligned securing element receiving openings in said double thickness attaching portion, one of said openings corresponding in cross section to an intended fastener, and the other of said openings being elongated in the direction of tab length.

2. The pull tab of claim 1 wherein said double thickness attaching portion includes inner and outer layers, said outer layer being in the form of a strap formed in said tab and hingedly attached to the remainder of said tab.

3. The pull tab of claim 2 wherein said strap is defined by a cutout and has a hinged connection with said force applying portion.

4. The pull tab of claim 3 wherein said inner layer is also in the form of a strap hingedly connected to said force applying portion.

5. The pull tab of claim 4 wherein said elongated opening is formed in said inner layer.

6. The pull tab of claim 2 wherein said elongated opening is formed in said inner layer.

7. The pull tab of claim 2 wherein force applying portion is further reversely folded and including said inner layer is of a four layer construction.

8. The pull tab of claim 2 wherein force applying portion is further reversely folded inwardly beneath itself, said force applying portion including said inner layer being of a four layer construction having two outer layers outwardly offset relative to the two inner layers, and said hinge connection between said attaching portion outer layer and said force applying portion being generally at said offset.

9. The pull tab of claim 1 wherein force applying portion is further reversely folded inwardly beneath itself, said force applying portion including said inner layer being of a four layer construction having two outer layers outwardly offset relative to the two inner layers.

10. The pull tab of claim 9 wherein said double thickness attaching portions form parts of said two outer layers.

11. A tab for easy opening containers comprising a tab body having a force applying portion at one end and a lifting portion at the other end, said force applying portion being particularly adapted for applying an inwardly directed rupturing pressure on a container panel when said lifting portion is moved outwardly, said tab having a bendable mounting ear positioned intermediate its ends for connection to a container panel, and means for effecting a plurality of shifting hinge axes on said ear for accommodating shifting the bend of the ear from one hinge axis to another attendant to back and forth ear bending movements of said tab and thus impeding fracture of said ear and thereby removal of said tab from an associated container.

12. The tab of claim 11 wherein said means includes a connecting strap underlying said mounting ear and having a fastener receiving opening therethrough elongated in the direction of tab length.

13. The tab of claim 12 wherein said connecting strap is integrally formed with the remainder of the tab in said force applying portion.

14. The tab of claim 11 wherein said connecting strap is integrally formed with the remainder of said tab in said force applying portion.

15. The tab of claim 11 wherein said mounting ear has a fastener receiving opening and said mounting ear is of a substantially constant width between said opening and its connection with the remainder of said tab.

16. The pull tab of claim 2 wherein said strap is of a substantially constant width between its opening and the remainder of said tab.

* * * * *